US006017224A

United States Patent [19]

Yanagida

[11] Patent Number: 6,017,224

[45] Date of Patent: Jan. 25, 2000

[54] METHOD OF SETTING CONTACTS IN A CONNECTOR HOUSING

[75] Inventor: Munekazu Yanagida, Itami, Japan

[73] Assignee: Japan Solderless Terminal Manufacturing Co., Ltd., Osaka, Japan

[21] Appl. No.: 09/154,862

[22] Filed: Sep. 16, 1998

[30] Foreign Application Priority Data

Sep. 17, 1997 [JP] Japan ..... 9-272194

[51] Int. Cl.[7] ..... H01R 9/09

[52] U.S. Cl. ..... 439/80; 29/882; 439/747

[58] Field of Search ..... 439/79, 80, 747, 439/741, 870, 872, 682; 29/882

[56] References Cited

U.S. PATENT DOCUMENTS

| | | | |
|---|---|---|---|
| 2,860,318 | 11/1958 | Morone, Jr. | 439/691 |
| 3,596,235 | 7/1971 | Teurlings | 439/80 |
| 3,697,933 | 10/1972 | Black et al. | 439/80 |
| 3,711,819 | 1/1973 | Matthews | 439/682 |
| 3,907,392 | 9/1975 | Haag et al. | 439/682 |
| 3,993,382 | 11/1976 | Brown | 439/79 |
| 3,995,869 | 12/1976 | Licht | 439/682 |
| 4,116,520 | 9/1978 | Zimmerman et al. | 439/79 |
| 4,597,625 | 7/1986 | Seidler | 439/682 |
| 4,790,773 | 12/1988 | Hahn | 439/682 |
| 4,878,849 | 11/1989 | Talwar et al. | 439/79 |

*Primary Examiner*—Neil Abrams

*Attorney, Agent, or Firm*—Antonelli, Terry, Stout & Kraus, LLP

[57] ABSTRACT

A connector housing (15) having compartments (16) for receiving socket-shaped bodies (12) of contacts (11) are prepared. The housing has slots (17) extending in parallel with the compartments. Further prepared are the socket contacts (11) each having an unfinished lead (13) that continues from the body (12) and has a bent portion (31) adjacent to it and continuing to a straight lead (13') in parallel with the body. Then, the socket-shaped body (12) of each contact (11) will be inserted in compartment (16), with the straight lead (13') being simultaneously inserted in the slot (17), so that the lead's end portion is exposed out of the housing (15) and subsequently bent to form a connectable leg (14) protruding downward from the housing (15), such that the leads are strongly held in the housing and reliably connected to a printed circuit board, besides the housing is protected from distortion when molded.

3 Claims, 3 Drawing Sheets

11
12
13
13'
14
15
16
17
23
31
32
33

METHOD OF SETTING CONTACTS IN A CONNECTOR HOUSING

BACKGROUND OF THE INVENTION

1. Field of the Invention

The present invention relates to a method of setting contacts, particularly socket contacts, in a housing for an electric connector.

2. Prior Art

There are known some types of connectors adapted for use with printed circuit boards wherein a plurality of socket contacts are secured in a housing of each connector. Each of the socket contacts that have not yet been set in place has an elongate unfinished lead continuing from the end of a socket-shaped body. In the prior art method, the unfinished lead is then bent to provide a straight lead extending generally in parallel with the socket-shaped body. An end portion of the straight lead will subsequently be bent again to form a connectable leg protruding down from the housing of a socket connector assembled this way. FIGS. 4(*a*) to 4(*e*) as whole illustrate such a prior art method of assembling the connector.

In detail, FIG. 4(*a*) shows the socket contact 1 referred to above and made by punching and pressing a thin sheet of a metal such as phosphor bronze. Its socket-shaped body 2 is of a shape to receive a pin contact (not shown). The elongate unfinished lead 3 extends downward from the rear end of a bottom of the socket-shaped body 2.

FIG. 4(*b*) shows a connector housing 5 made of an insulating material such as a Nylon (registered trademark) so as to accommodate a plurality of such socket contacts 1. Compartments 6 formed side by side and in a row will respectively hold therein the socket bodies 2 of those contacts. Groove-shaped cutouts 7 for receiving the elongate unfinished leads 3 are located in a bottom of the housing 5, correspond to the respective compartments 6. Each cutout 7 extends from the rear end to a front end of the housing 5. The reference numeral 8 denotes a lockable arm engageable with a mating connector.

FIGS. 4(*c*) to 4(*e*) show the sequential steps of incorporating the socket contacts 1 into the connector housing 5. The socket-shaped body 2 of each contact 1 will at first be put in the compartment 6, from rear of the housing. Then, the unfinished lead 3 extending from each body 2 thus fixed in said compartment will be bent using a tool 21 so as to have a major portion fitting in the groove-shaped cutout 7. This bent major portion of each unfinished lead 3 lies straight along a bottom of said cutout 7, substantially in parallel with the body 2. Such a major portion protruding forward from the front of housing 5 is referred to herein as a —straight lead 3'—. Subsequently, a rear part of this straight lead 3' fitting in the cutout 7 will be held in place with an anvil 22 as shown in FIG. 4(*d*) so that a further tool 23 may press down a frontal part of said lead 3' to form a leg 4 connectable to a printed circuit board (see FIG. 4(*e*)).

Since there is no element or member disposed below and supporting each straight lead 3', those socket contacts 1 set in the housing 5 by the prior art method are not necessarily held firmly enough to be immovable relative thereto. In particular, those straight leads 3' and their connectable legs 4 are susceptible to deformation caused by external force. Thus, it has been considerably difficult to firmly retain the legs 4 on any printed circuit board. Further, presence of a large number of groove-shaped cutouts 7 between the frontal and rear bottom ends of the housing 5 has often caused it to become distorted when molded.

SUMMARY OF THE INVENTION

The present invention was made to diminish these problems in the prior art. Therefore, it is an object of the present invention to provide a novel method of setting contacts in a housing as well as the contacts and the housing themselves that are advantageously employable in the present method, such that the housing can firmly retain each contact's straight lead, whether unfinished or finished, and in use the finished lead can reliably be fixed on a printed circuit board. Another object is to protect the housing from distortion that has been likely to take place when molding same.

In order to achieve all of these objects at once, a connector housing prepared beforehand for use in the method of the present invention has compartments for receiving socket-shaped bodies of socket contacts, and further has slots penetrating the housing fore and aft and extending generally in parallel with the compartments. Each of the socket contacts also prepared prior to use in the present method has the socket-shaped body and an elongate unfinished lead continuing from the end of said body, and this unfinished lead is processed to form a bent portion adjacent to the socket-shaped body as well as a straight lead continuing from said bent portion and lying generally in parallel with said body. In the present method, the socket-shaped body of each socket contact will be inserted in one of the compartments, accompanied by simultaneous insertion of the straight lead into one of the slots corresponding to the one compartment. Subsequent to this step, an exposed end portion of the straight lead will be bent to form a connectable leg protruding downward from the housing.

This method and system are advantageous in that the contacts' straight leads are more firmly secured in the respective elongate slots. Any groove-shaped cutouts are no longer necessary in the housing's bottom region, thus avoiding the serious problem of distortion in the molded housings.

BRIEF DESCRIPTION OF THE DRAWINGS

FIGS. 1(*a*) to 1(*e*) illustrate as a whole a process of incorporating socket contacts into a connector housing, according to the method proposed herein, wherein:

FIG. 1(*a*) is a vertical cross section of one socket contact comprising a socket-shaped body and an unfinished lead continuing therefrom;

FIG. 1(*b*) also is a vertical cross section of the socket contact whose unfinished lead has been bent to form a straight lead;

FIG. 1(*c*) similarly is a vertical cross section of a connector housing comprising compartments and slots;

FIG. 1(*d*) is a cross section showing the step of inserting the socket-shaped body as well as the straight lead of each contact respectively into one of the compartments and into one slot corresponding thereto, before bending down an exposed end of said straight lead;

FIG. 1(*e*) is a vertical cross section of the connector thus finished;

FIGS. 4(*a*) to 4(*e*) illustrate as a whole a process of incorporating socket contacts into a connector housing, according to one of the prior art methods, wherein:

FIG. 4(*a*) is a side-elevational cross section of one socket contact comprising a socket-shaped body and an unfinished lead continuing therefrom;

FIG. 4(*b*) is a side-elevational cross section of a connector housing comprising compartments and groove-shaped cutouts;

FIG. 4(*c*) shows the first step of placing each contact in the housing and bending the unfinished lead to form a straight lead;

FIG. 4(*d*) shows the subsequent step of further bending the straight lead; and FIG. 4(*e*) is a vertical cross section of the connector thus finished.

THE PREFERRED EMBODIMENTS

Figure 1:
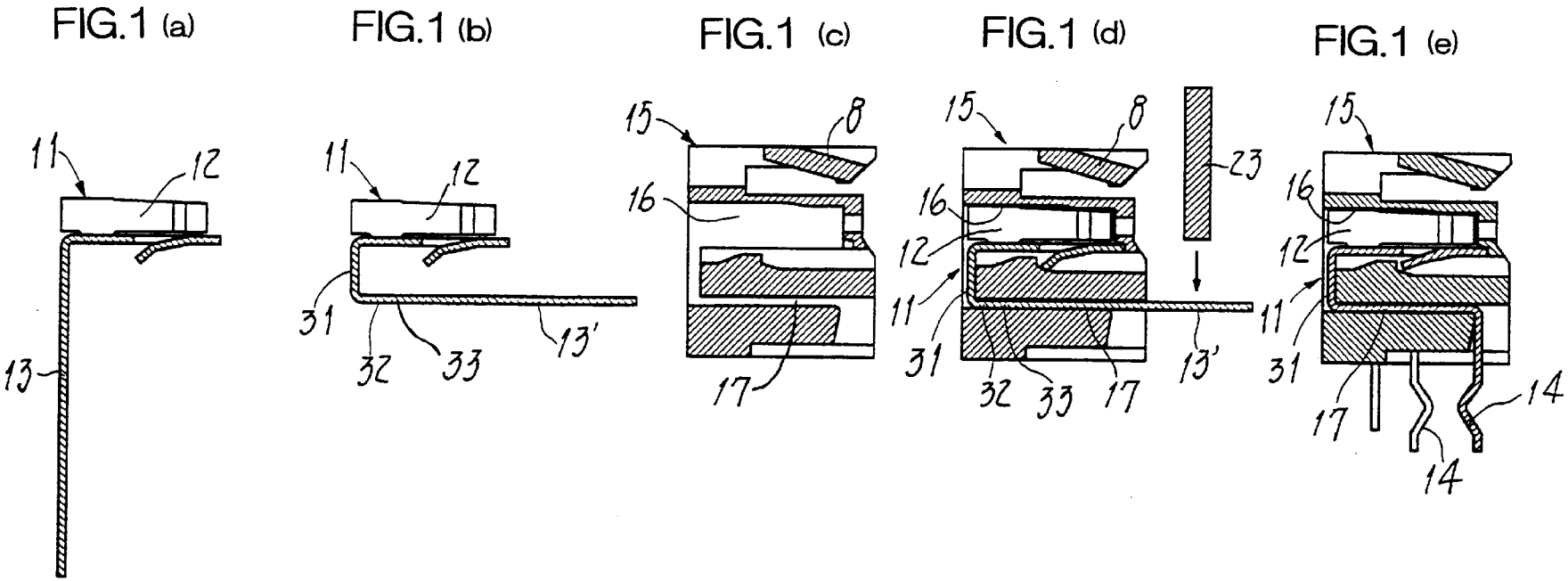
Figure 2:
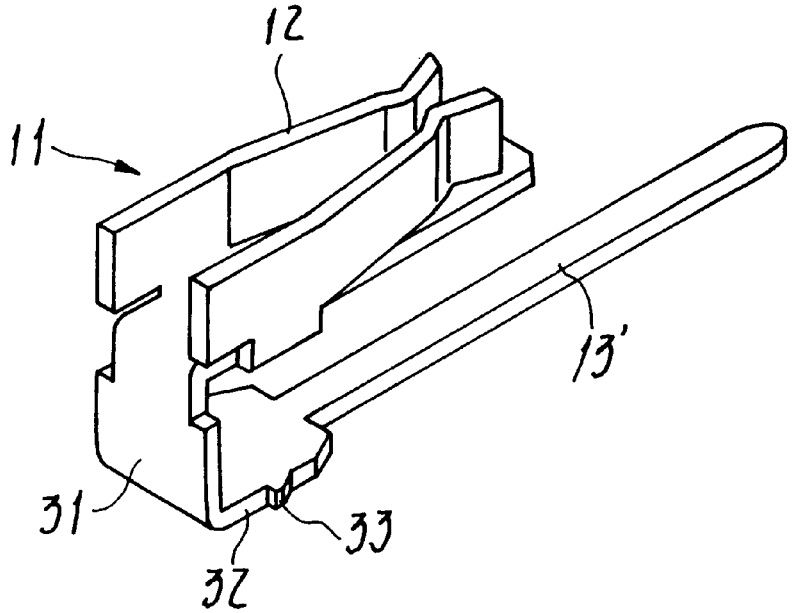
FIG. 2 is a perspective view of the contact prepared beforehand for use in the present method.
Figure 3:
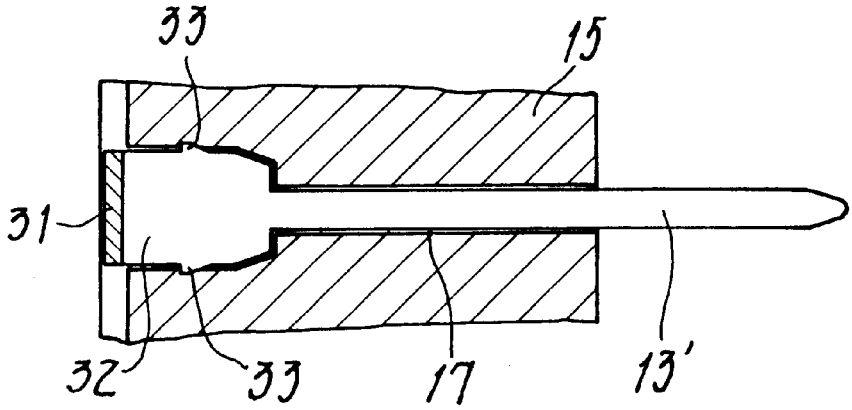
FIG. 3 is a horizontal cross section of relevant members wherein the unfinished lead penetrates the housing.
Figure 4:
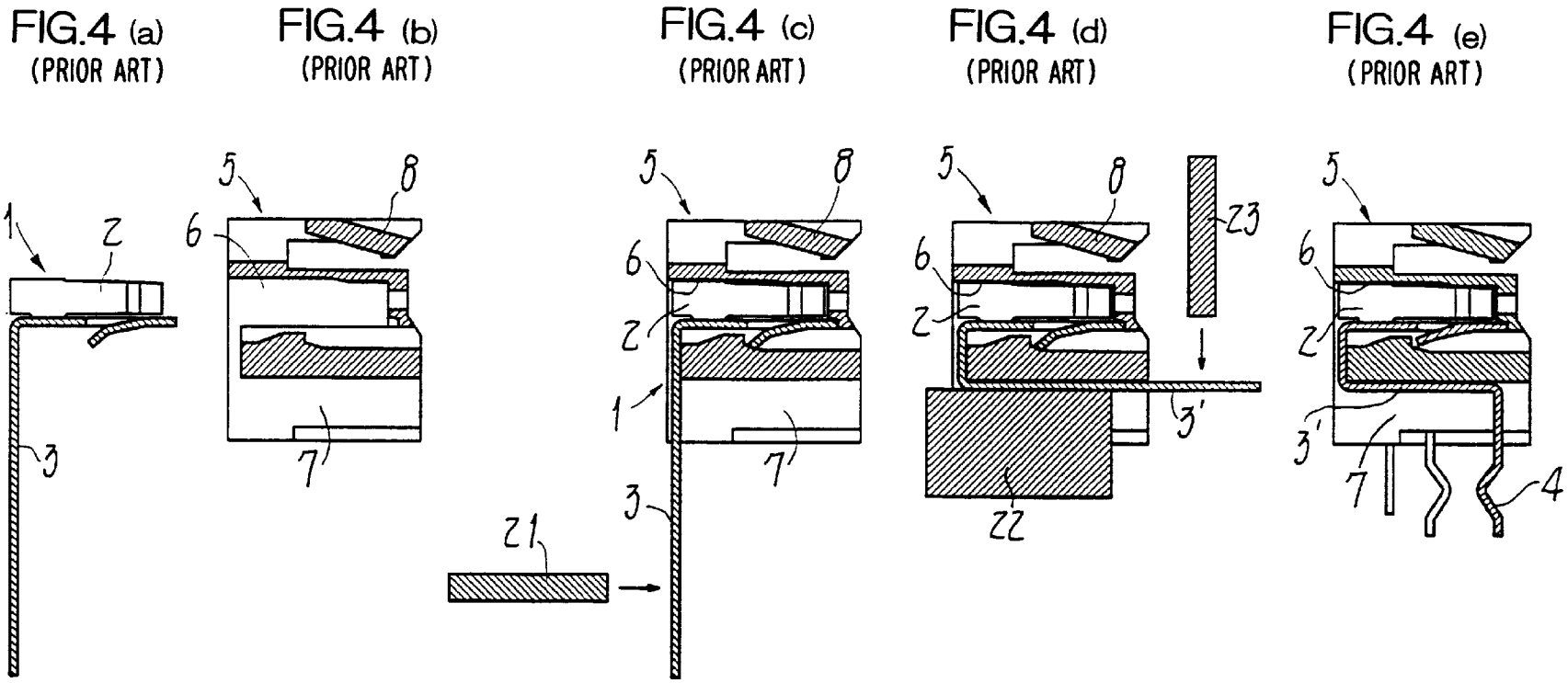
FIG.4 (a) (PRIOR ART)
FIG.4 (b) (PRIOR ART)
FIG.4 (c) (PRIOR ART)
FIG.4 (d) (PRIOR ART)
FIG.4 (e) (PRIOR ART)

FIG. 1(*a*) shows a socket contact 11 for use in the method of the present invention. This contact made by pressing a thin conductive metal sheet such as a phosphor bronze sheet has a socket-shaped body 12. An elongate unfinished lead 13 continues, like the prior art contact shown in FIG. 4(*a*), from the rear end of the body's bottom. However, the unfinished lead 13 is already bent before use in the present method so as to provide a bent portion 31 and a straight lead 13' continuing therefrom as seen in FIG. 1(*b*). FIG. 2 shows that the previously processed contact 11 has the bent portion 31 continuing to a basal end portion 32 of the straight lead 13', with both the portions being rendered wider than the remainder portion of said lead. Pawls 33 protrude from lateral edges of the basal end portion 32 so that they may be hooked in a housing 15 that will be detailed below.

FIG. 1(*c*) shows a connector housing 15 for receiving a plurality of the socket contacts 11. Similarly to the prior art housing shown in FIG. 4(*b*), this housing 15 also made of an insulating material such as a Nylon (registered trademark) has compartments 16 formed therein and arranged side by side to respectively receive the contacts' socket-shaped bodies 12. However, flat and elongate slots 17 penetrating the housing 15 substantially in parallel with the compartments 16 do substitute for the prior art groove-shaped cutouts 7. The straight lead 13' formed from each unfinished lead 13 will fits tightly in each of such slots 17. An inlet region of the slot 17 is rendered broader than the remainder regions thereof so as to match the wider basal end portion 32 of each straight lead 13'.

In assembling the connector, those socket-shaped bodies 12 already prepared beforehand will be put in the compartments 16 of the housing, from its rear side, so that the straight leads 13' fit in and through the slots 17 (see FIG. 1(*d*)). The pawls 33 of each lead will bite the housing's 15 inner faces defining the inlet region of each slot, thereby fastening the lead therein. Subsequently, a tool 23 will be used to bend free end portions of leads 13' protruding beyond the front of the housing 15. These leads' end portions are thus bent downward to form legs 14 ready for connection to a printed circuit board (see FIG. 1(*e*)). It is not required herein to use any anvil 22 or the like prior art auxiliary tool shown in FIG. 4(*d*), because the straight leads 13' tightly fitting in the slots 17 are held immovably relative to the housing 15.

Thus, the socket contacts 11 whose straight leads 13' are fixed in the slots 17 of the housing 15 are kept stable therein, whereby their legs 14 can now be connected more firmly to a printed circuit board.

In summary, the method proposed herein is advantageous in that the contacts, particularly their leads, are very strongly held in the housing and more reliably connected to any printed circuit board. The housing free of any groove-shaped cutouts extending over its full width is now free from the problem of distortion that has been inherent in the prior art housings.

What I claim is:

1. A method of setting contacts in a connector housing wherein the contacts are socket contacts, the method comprising the steps of:

preparing the connector housing having compartments for receiving socket-shaped bodies of the socket contacts, and further having slots penetrating the housing fore and aft and extending in parallel with the compartments;

further preparing the socket contacts each having an elongate unfinished lead continuing from an end of the socket-shaped body and having a bent portion adjacent thereto as well as a straight lead that continues from the bent portion and lies in parallel with the socket-shaped body;

then inserting the socket-shaped body of each socket contact in one of the compartments so that the straight lead is simultaneously inserted into one of the slots corresponding to the one compartment, whereby an end portion of the straight lead protrudes out of the housing so as to be exposed; and subsequently bending the exposed end portion of the straight lead to form a connectable leg protruding downward from the housing.

2. A connector housing for use in the method as defined in claim 1, wherein the connector housing has the compartments for receiving the socket-shaped bodies of the socket contacts, and further has the slots extending in parallel with the compartments and being flat to closely fit on the straight leads.

3. A socket contact for use in the method as defined in claim 1, wherein the socket contact has the elongate unfinished lead continuing from the end of the socket-shaped body and also has the bent portion adjacent thereto as well as the straight lead continuing from the bent portion and lying in parallel with the socket-shaped body, and wherein a basal end portion of the straight lead is wider than the remainder thereof and has pawls protruding from opposite side of the basal end portion.

* * * * *